US005143266A

United States Patent [19]

Heckerman et al.

[11] Patent Number: 5,143,266

[45] Date of Patent: Sep. 1, 1992

[54] HARNESS

[75] Inventors: Willaim L. Heckerman, Bozeman; Brad B. Heckerman, Belgrade, both of Mont.

[73] Assignee: Butler Creek Corporation, Belgrade, Mont.

[21] Appl. No.: 489,473

[22] Filed: Mar. 5, 1990

Related U.S. Application Data

[62] Division of Ser. No. 348,717, May 8, 1989, Pat. No. 4,924,557, which is a division of Ser. No. 817,420, Jan. 10, 1986, Pat. No. 4,827,578.

[51] Int. Cl.[5] ..... A45F 3/00

[52] U.S. Cl. ..... 224/150; 224/202; 224/264; 224/908; 224/909; 224/913

[58] Field of Search ..... 224/150, 202, 204, 205, 224/207, 208, 209, 223, 254, 255, 257, 258, 259, 260, 264, 907, 908, 909, 913

[56] References Cited

U.S. PATENT DOCUMENTS

| | | | |
|---|---|---|---|
| 860,395 | 7/1907 | Lindsey | 224/264 X |
| 1,723,276 | 8/1929 | Gottlieb | 224/247 X |
| 2,264,481 | 12/1941 | Peterson | 224/250 X |
| 2,628,749 | 2/1953 | Ryden | 224/247 X |
| 2,651,441 | 9/1953 | Rau et al. | 224/264 X |
| 2,779,521 | 1/1957 | Granberg | 224/150 |
| 3,767,095 | 10/1973 | Jones | 224/907 X |
| 4,069,954 | 1/1978 | Rauch | 224/918 X |
| 4,085,872 | 4/1978 | Foo | 224/205 |
| 4,401,246 | 8/1983 | Dickinson et al. | 224/150 |
| 4,550,869 | 11/1985 | Johnson | 224/202 |
| 4,976,388 | 12/1990 | Coontz | 224/264 |

FOREIGN PATENT DOCUMENTS

| | | | |
|---|---|---|---|
| 0104538 | 4/1984 | European Pat. Off. | 224/202 |
| 590382 | 1/1934 | Fed. Rep. of Germany | 224/209 |
| A19943 | 10/1955 | Fed. Rep. of Germany | 224/264 |
| 1423486 | 2/1965 | France | 224/264 |

*Primary Examiner*—Henry J. Recla
*Assistant Examiner*—Robert M. Fetsuga
*Attorney, Agent, or Firm*—Richard C. Conover

[57] ABSTRACT

The harness comprises a carrying strap and a gripper. The carrying strap is formed from a soft material. Another strap formed from a stronger, less resilient fabric is attached to the soft strap at uniformly spaced intervals and in such a way that the second strap forms loops at its points of attachment to the soft strap. With the arrangement, the soft strap can only stretch until the loops become taut. Thereafter, the stronger second strap carries the load and this prevents the soft strap from tearing when heavy loads are carried. The gripper is formed from a resilient material and comprises a first plate and a second plate which are connected together by an arcuate web. One of the plates of the gripper has a flat body contacting surface and a loop is positioned in the arcuate web between the first and second plates for connection to a device to be carried. A plurality of pins are formed on at least one plate of the gripper. These pins penetrate the strap and attach the first and second plates of the gripper to the opposite surfaces of the end of the strap when the plates are squeezed together with the end of a carrying strap between them.

3 Claims, 6 Drawing Sheets

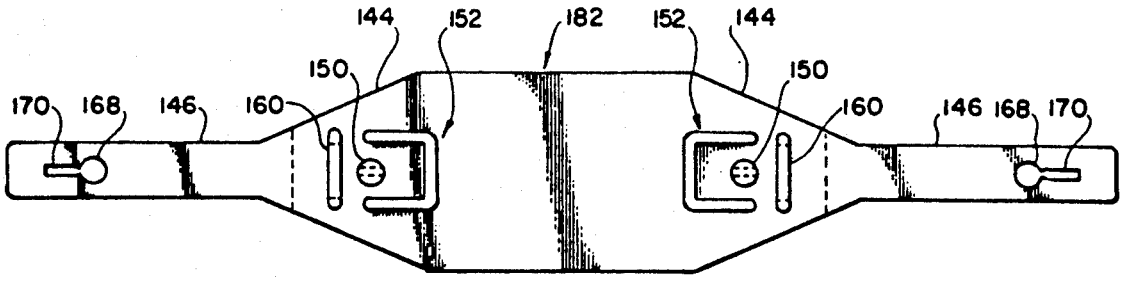
FIG. 22.
FIG. 23.
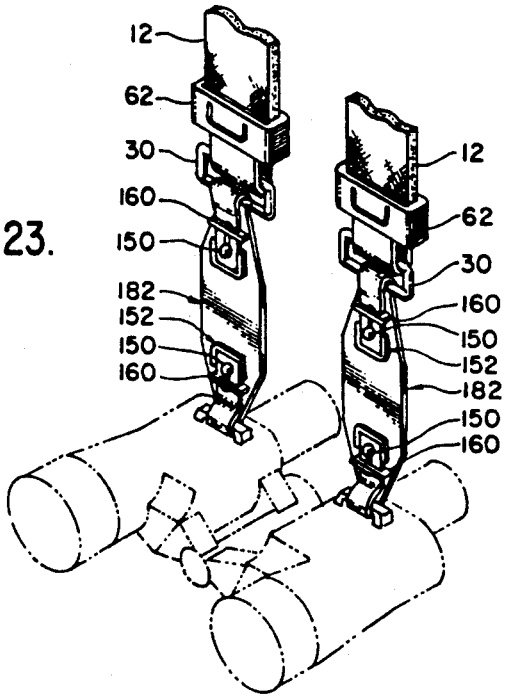

HARNESS

This application is a division of application Ser. No. 348,717 filed May 8, 1989, now U.S. Pat. No. 4,924,557, which is a division of application Ser. No. 817,420, filed Jan. 10, 1986, now U.S. Pat. No. 4,827,578.

This invention relates to a carrying strap and more particularly to a harness and to the connectors attached to the harness.

PRIOR ART AND BACKGROUND

Harnesses or carrying straps have long been used by people and animals for carrying heavy and/or awkwardly shaped objects. But only in recent time has serious attention been directed to the importance of designing straps or harnesses that are comfortable to the wearer when carrying heavy loads over rough terrain for long distances. Solutions to this problem are complicated because even poorly designed harnesses are not uncomfortable when the load being carried is light or the distance to be covered is small. It is only when the harness must be used to carry heavy loads over rough terrain for long distances, that the harness or poorly designed components attached to the harness can cause problems and discomfort. Consequently, even tiny metal components such as irregularly shaped metal spring clips could cause skin irritation when rubbing against an animal or a person's body for a prolonged period of time. Moreover, when the harness is used on an animal, skin abrasions may not be noticed until the animal is injured.

One of the reasons prior harnesses or carrying straps were uncomfortable was that they were made from leather or some other inelastic fabric webbing. With this structure, repeated shocks when carrying loads over a rough terrain, were transmitted directly to the body of the person carrying the load, which became increasingly painful.

If the harness were formed from some other material, such as neoprene foam, the harness would be more comfortable because the neoprene straps being elastic and soft would function as a shock absorber and distribute shocks caused by the load more uniformly to other parts of the body. However, straps formed from neoprene or similar materials have limited strength, and to overcome this limitation, means must be provided to strengthen them without at the same time destroying their function as a shock absorber. Therefore, one of the objects of this invention is to provide a harness or carrying strap made from a material such as a neoprene foam, but modifying it so that the strap is strong enough to bear heavy loads without tearing and without impairing its softness or its function as a shock absorber.

Connectors are attached to harnesses formed from leather or some fabric webbing so that the harness can be attached to the object being carried, as exemplified by the patents to: Harrow U.S. Pat. No. 4,461,411; Parlente U.S. Pat. No. 3,352,467; Cookman U.S. Pat. No. 2,564,464; Brewer U.S. Pat. No. 4,168,022; Lyer U.S. Pat. No. 4,320,863; Brewer U.S. Pat. No. 4,058,242; and U.S. Pat. No. 3,884,403. In these examples, the strap is attached to a connecting ring by looping the end of the strap through the connecting ring and then sewing the ends of the strap together to form a loop which is interlocked with the connecting ring. But this arrangement is not practical if the harness strap is formed from neoprene foam or some material with similar physical characteristics because a loop formed from a neoprene strap would not be strong enough to withstand the shocks caused when a person or animal using the harness strap walks or climbs over a rough terrain carrying a heavy load. Alternatively, when the harness or carrying strap is formed from leather, a separate leather strap is looped through the connecting ring or loop and this strap is attached permanently or releasably by means of a buckle to the main leather strap. The tongue of the buckle extends through a hole formed in the leather strap in a manner well known in the Art. But this arrangement is not practical if the harness is formed from a material such as neoprene foam. The reason is a tongue receiving hole formed in the neoprene strap to receive the tongue of the buckle, would soon elongate and tear when the harness is subjected to heavy loads.

Another way to attach a connector to a strap is disclosed in the patent to Crapsey U.S. Pat. No. 2,521,903 wherein the end of the strap has a rivet receiving hole formed in it. A V-shaped spring connector is provided with a rivet on one wall and a rivet receiving hole on the other wall. The end of the strap is inserted between the walls of the connector and the walls of the connector until the tongue on one wall extends through the rivet receiving hole in the strap and through the other wall of the connector. Then a keeper or sleeve is slid over the spring connector to hold the walls of the connector together with the strap locked to the connector. But this arrangement is unsuitable for straps or harnesses formed from neoprene foam because, as described above, forces exerted on the strap pulling it away from the connector, would soon elongate the tongue receiving hole in the strap causing the strap to tear.

In addition to a connecting ring or loop attached to a harness strap, a releaseable connector of some sort is required for attachment both to the connecting ring or loop and to the object bearing carried. Heretofore, as exemplified by the patents to Harrow U.S. Pat. No. 4,461,411, 3,884,403, and Brewer U.S. Pat. No. 4,058,242, metal releaseable spring clip or connector was used for this purpose. However, in addition to being somewhat expensive, metal connectors like these had irregular and lumpy shapes which could press against the body of the person or animal using the harness to carry loads and eventually irritate the skin.

If both the metal spring connector and the connecting ring or loop described above could be replaced by a releaseable connecting device which has a flat resilient body contacting surface that can lie flat against the body of an animal or person using the harness to carry heavy loads, the discomfort caused by the present metal spring connectors could be avoided.

A connecting device employing a grommet and a nipple, as exemplified by the patents to Ade U.S. Pat. No. 1,341,406, Martin U.S. Pat. No. 1,368,818, and Adams U.S. Pat. No. 3,427,693 provide an alternative to the irregularly shaped metal spring connector. But these devices were not suitable for use in a harness carrying heavy loads and/or expensive equipment, because there was no convenient and safe way to lock the nipple in the grommet. If such a connecting device were used in a harness carrying heavy loads or expensive equipment, shocks and vibration caused when the person walks or climbs over rough terrain could cause the nipple to separate from the grommet permitting the load or equipment to fall off the harness or carrying strap.

What is needed therefore and compromises another important object of this invention, it to provide a connector which can make a strong connection to the ends of a harness strap formed from a neoprene foam or some similar material and which has a flat body engaging surface to increase the comfort of the person or animal using the harness.

Yet a further object of this invention is to provide a releaseable attaching device for a harness which has flat body engaging surfaces, so contact between these body engaging surfaces and the body of the person or animal using the harness does not cause discomfort. Yet another object of this invention is to provide a carrying strap for a harness which is made from a soft resilient material which can carry heavy loads without tearing.

Still a further object of this invention is to provide a connector employing a nipple and grommet in such a way that the nipple and grommet can be locked together and will not separate when subjected to shock and vibration.

These and other objects of this invention will become more apparent and better understood in the light of the accompanying specification and drawings wherein.

Figure 17:
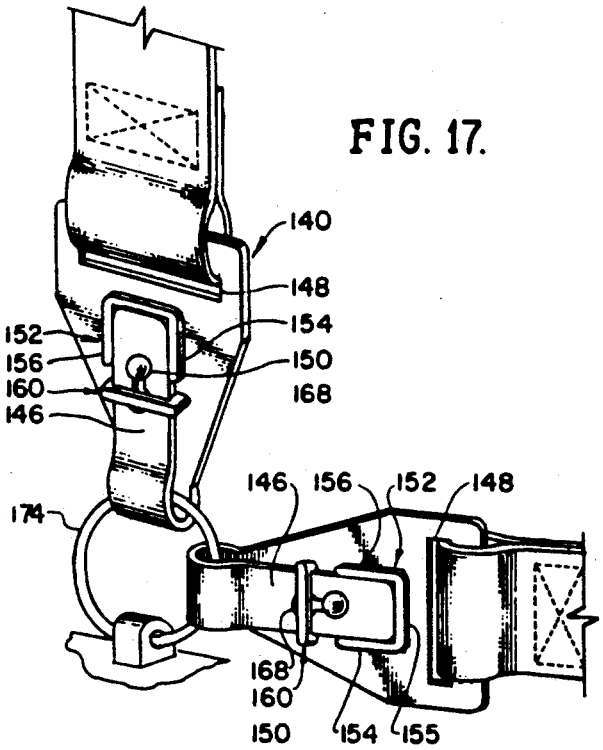
FIG. 17 is a perspective of the combined attaching loop and connector shown in FIG. 14, attached to a connecting ring and disclosing the flat body-engaging surfaces which make the combined attaching loop and connector comfortable to use in a harness.
Figure 18:
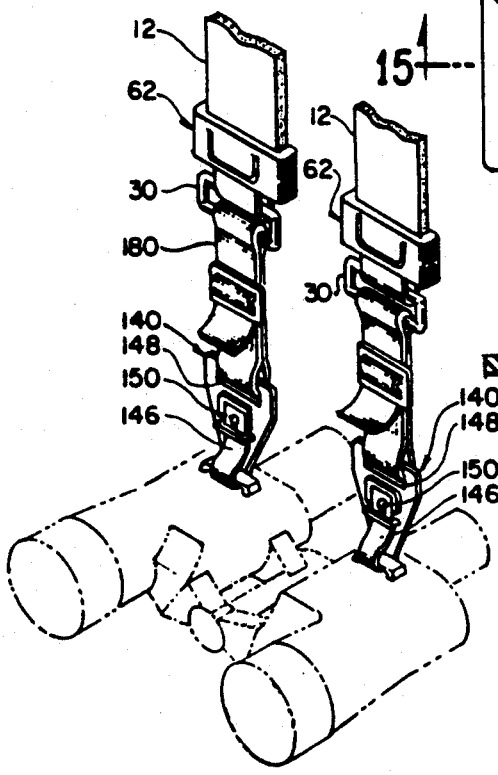

FIG. 18 discloses the combined attaching loop and connector shown in FIG. 17 attached to a pair of binoculars.

Figure 19:
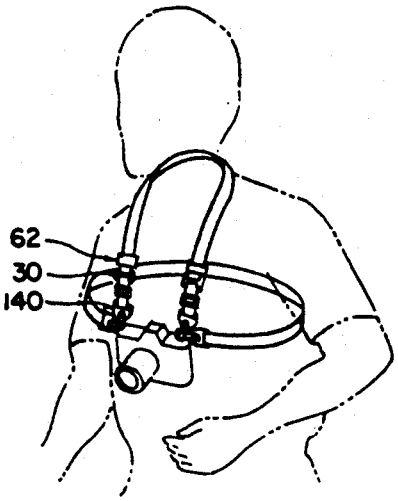

FIG. 19 is a perspective view of a harness using the various connectors described herein attached to a camera.

Figure 20:
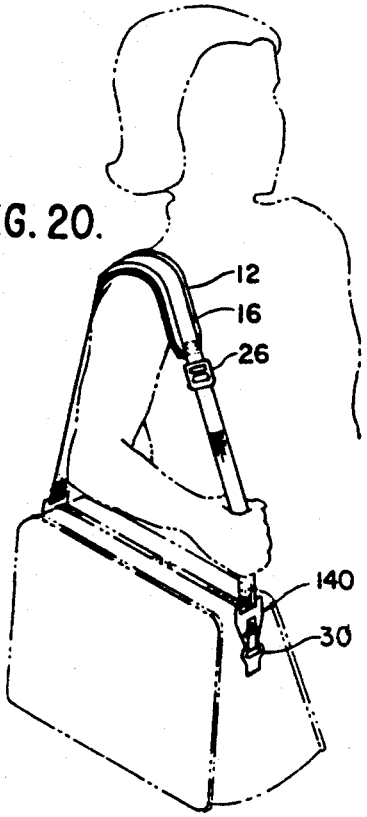

FIG. 20 shows the improved harness used to carry a diaper bag around the shoulders of a woman.

Figure 21:
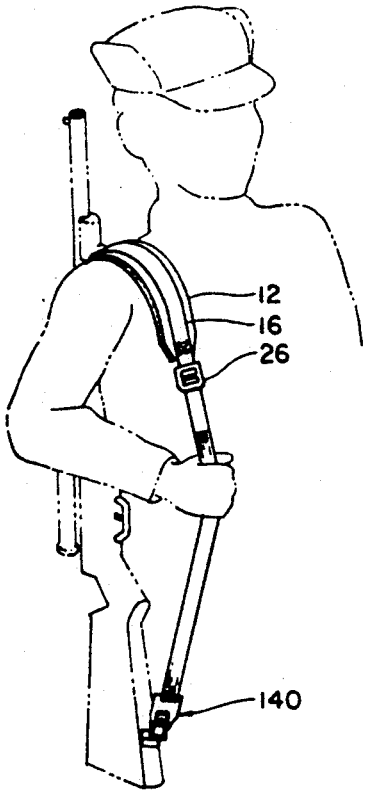

FIG. 21 shows the improved harness used to carry a rifle around the shoulders of a soldier or hunter.

FIG. 22 is a plan view of a double releaseable connector in an unfolded position.

FIG. 23 is a perspective view of the double connector shown in FIG. 22 attached to a harness strap and a pair of binoculars.

Figure 1:
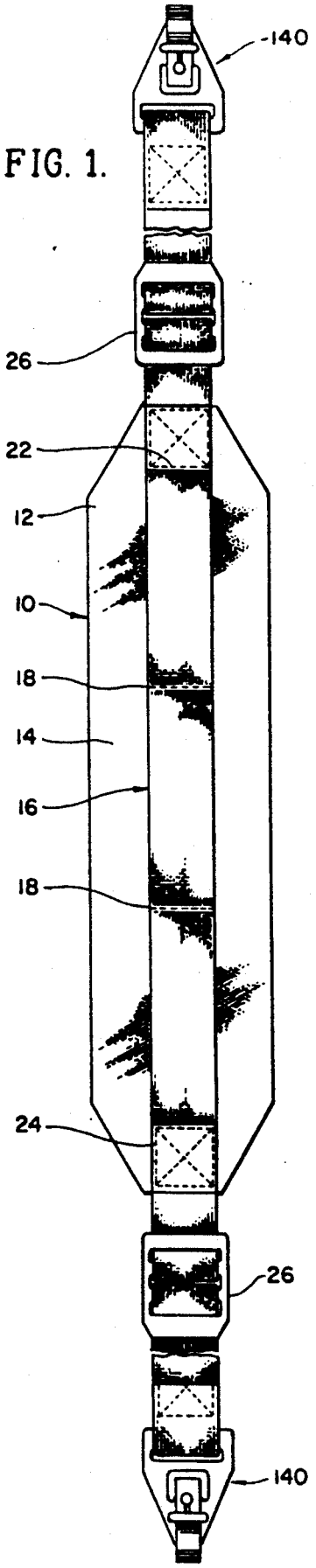
FIG. 1 is plan view of the upper side of a neoprene foam strap with a reinforcing elastic or fabric web and a flat connector.
Figure 2:
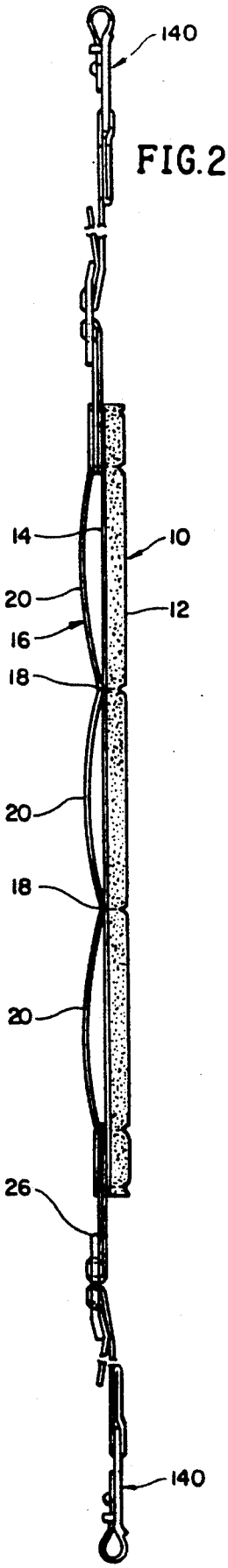
FIG. 2 is a side view of the neoprene strap shown in FIG. 1 disclosing the loops of a reinforcing fabric web which serve as a secondary shock absorber.

Referring now to FIGS. 1 and 2 of the drawing, a harness or carrying strap indicated generally by the reference numeral 10 comprises a strap 12 formed from neoprene foam or some other material with similar characteristics. Neoprene foam is soft and resilient. When a strap formed from this material is substantially wider than the prior straps formed from leather or a fabric webbing, the load carried by the harness strap is distributed over a larger area of the body. This makes the strap more comfortable when carrying heavy or awkwardly shaped objects for a long period of time. In this way, strap 12 functions as a primary shock absorber.

One or both of the outer surfaces of the strap 12 may be covered by a layer of nylon fabric 14. This fabric has two functions. One is to reinforce the strap 12 so it will not tear readily when stretched, and other is to provide a surface on which decorative designs or messages can be printed.

In the course of time a harness or carrying strap formed from neoprene foam or some similar material, even when covered by a nylon fabric, will tear when the harness is subjected to strong stretching forces caused when an animal or person using the harness carries a heavy load while walking or climbing over rough terrain.

To prevent this from happening, a secondary strap 16 formed from a strong fabric, such as nylon or other elastic webbing, is attached to the outer surface of the strap 12 at uniformly spaced intervals 18 to form loops 20, see FIG. 2. The loops are sized so they became taut and take up the burden of the load carried by the harness before forces stretching the strap 12 exceed its elastic limit, thereby preventing the strap from tearing.

In use, when a person or animal carrying a heavy object with a carrying strap or harness made, as shown, from neoprene foam or a material with similar physical characteristics, walks over a flat terrain, shocks and vibration are taken up by the small expansions and contractions of the strap 12. These are too small to permit the load being carried to bounce or shift enough to cause discomfort. But when the person or animal walks or climbs over a rough terrain, the shocks and vibrations increase substantially causing the neoprene strap 12 to stretch further. However, the strap 12 can only stretch until the loops 20 become taut. Thereafter the strap 16 formed from the fabric webbing carries the load. At the same time, the comparatively greater width of strap 12 in comparison to the width of the fabric webbing 16, distributes the load of the harness over larger areas of the body, and this coupled with the softer material forming the strap 12 cushions the pressure of the load and prevents abrasions from developing when the harness is utilized to carry heavy loads for long distances, see FIGS. 20 and 21. In this way, the neoprene foam strap 12 and the fabric webbing or elastic strap 16 coact and function as a secondary shock absorber for rough terrain.

As seen in FIG. 1, strap 16 is secured to the extreme end 22 and 24 of strap 12. This makes the harness more comfortable because the ends of strap 12 will always lie flat against the surface of the body of the person using the harness, and the ends 22 and 24 of the strap 12 can never fold over itself. The ends of strap 16 extending beyond the ends of strap 12 may be connected to conventional adjustable strap members 26 or to other connectors described below.

When the object being carried is comparatively light such as a camera or diaper bag, the stretching forces exerted on strap 12 may always remain below its elastic limit. In that event, the secondary strap 16 may not be required. But whatever load is carried by a harness using a neoprene foam strap 12, the end of the strap must be securely attached to something like the loop 30, see FIG. 4. This may be done by molding a gripper 32 preferably from a resilient material such as a high-density polyethylene, delrin, or a like material. The gripper comprises two spaced walls or plates 34 and 36 connected through a connecting plate 60 to a generally arcuate member 38 which serves as a hinge. For reasons to be described below, the width of the U-shaped or arcuate member 38 is preferably less than the width of at least one of the spaced plates. The gripper 32 includes a plurality of strap penetrating projections or pins 40 and 41 extending perpendicular to the surface of plate 34 and a pair of pin-receiving holes 42. The gripper 32 is also formed so plate 36 has a plurality of pin-receiving holes 46 for receiving the pins 40 and a pair of larger pin-receiving holes 48 which are sized like holes 42 in plate 34.

In this embodiment the width of plate 36 is less than the width of plate 34 and the width of plate 34 is generally equal to the width of the strap 12 so nothing projects very far beyond the sides of the strap, making the harness more attractive. In addition, the lateral spacing between pins 41 is generally equal to the width of plate 36. This gives the pins 41 a guiding function as well as a strap holding function. Moreover, the plates have flat body contacting surfaces so when the gripper is used in a harness, the body contacting surfaces can lie comfortably against the body of a person or animal using the harness to carry a load.

Figure 3:
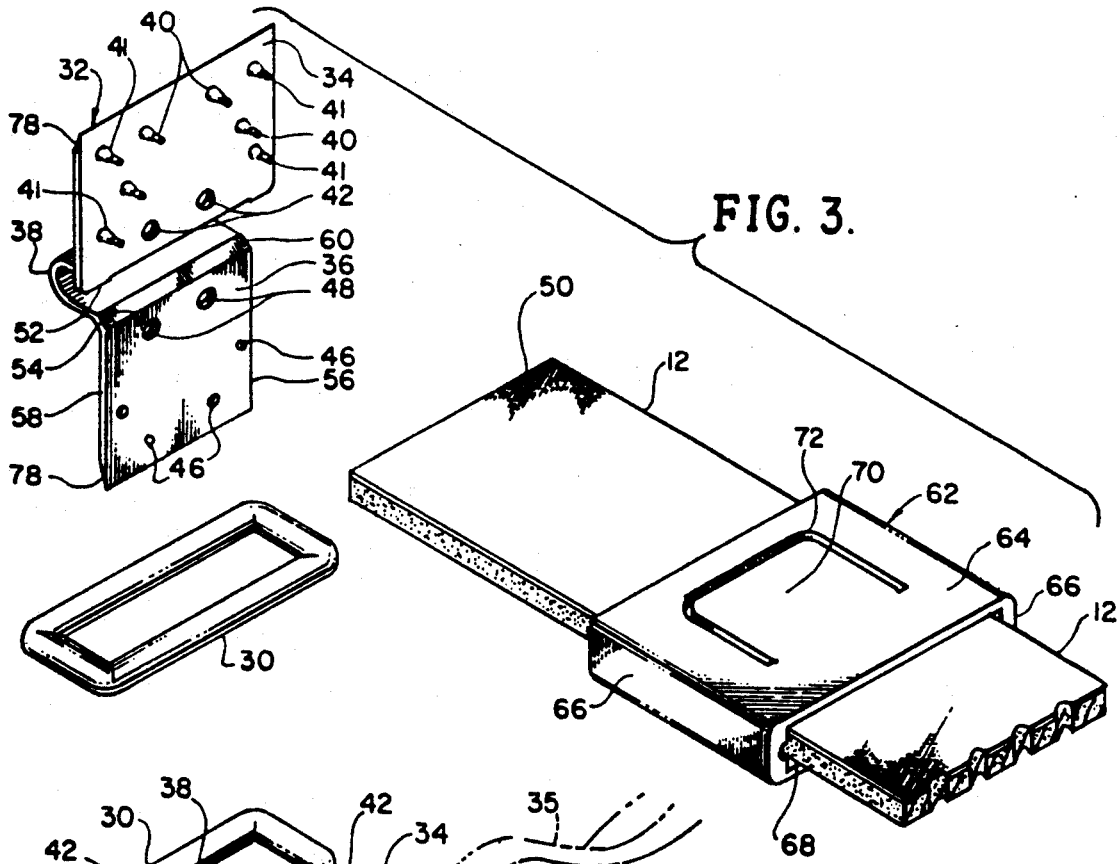
FIG. 3 is a an exploded perspective of a flat gripper which serves to grip the end of a neoprene foam strap for attachment to a rectangular connecting loop.
Figure 4:
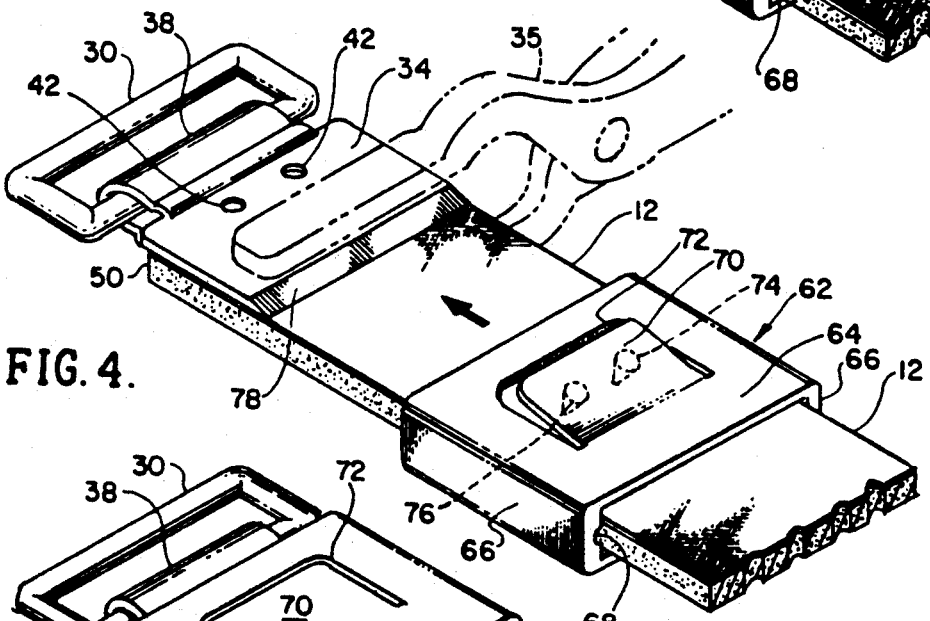
FIG. 4 is a perspective of the end of the neoprene strap and gripper shown in FIG. 3 in an intermediate state of assembly.

In assembled relation, plates 34 and 36 are bent towards each other until they are generally parallel to each other and are separated by the thickness of the strap 12, see FIG. 4. Loop 30 is first positioned in the arcuate or U-shaped member 38. Then the strap 12 is inserted between them, with the edge 50 of the other strap 12 aligned with the inner ends 52 and 54 of plates 34 and 36, see FIG. 3. When the plates 34 and 36 are pressed against each other by means of a clamping tool 35 or some special fixture, and with the end of strap 12 between them, as shown in FIG. 4, the pins 40 penetrate through the foam strap 12, into the pin-receiving holes 46. At the same time, the pins 41 penetrating the end of the strap engage the side edges 56 and 58 of plates 36.

When the sides of the pins 41 engage the opposed side edges of plate 36, the plate 36 is guided and positioned so the pins 40 on plate 34 are aligned with the pin-receiving holes 46 in plate 36. Thereafter, when the plates 34 and 36 are squeezed together with the strap 12 between them, the pins 40 and 41 are forced through the strap 12 into the pin-receiving holes 46. In this way, the pins 40 will be supported at both ends so that forces tending to pull the strap away from the gripper 32 cannot break the pins. In addition, the number of pins extending through the end 50 of strap 12 divide any pulling forces exerted on the strap 12 among all the pins 40 and 41 so that the tearing strength of the strap 12 is not substantially impaired.

As stated above, the width of the arcuate member 38 is less than the width of plate 34, the widest plate of the gripper. With this arrangement, the width of the loop 30 can be limited to the width of the strap 12 so that the loop 30 will not extend beyond the sides of the strap and possibly snag on vegetation or rocks when climbing over rough terrain.

In order to hold the plates 34 and 36 in gripping engagement with the end of strap 12, a keeper 62 is provided. The keeper 62 is, in this embodiment, a sleeve preferably molded from a resilient, high-density polyethylene or delrin or similar material and is generally rectangular in cross-section with identical upper and lower walls 64 and connecting side-walls 66, see FIGS. 3, 4 and 5. The sleeve has an opening for receiving the strap 12. The inner surface of the side-walls 66 may be provided with a groove 68 for receiving the edges of strap 12 when the strap 12 is forced through the keeper or sleeve 62. The sleeve 62 is dimensioned so when it is mounted on the plates 34 and 36 of the gripper, it tightly embraces and squeezes them together.

Surface 64 of the keeper 62 is provided with a generally rectangular tongue 70 formed by cutting a corresponding U-shaped slot 72 in the top and bottom walls 64. Inwardly projecting generally conical pins 74 and 76 are molded to the underside of the tongue 70, see FIG. 4. The length of the pins is the same as the thickness of the plates 34 and 36 to penetrate pin-receiving holes 42 and 48 in plates 34 and 36 when the tongue 70 is coextensive with the wall 64. The pins 74 and 76 may have beveled or angled leading edges to more easily ride up cam surface 78 when forced by the sleeve or keeper 62 so that the pins 74 and 76 dropping in the holes 42 and 48 keep the assembly together.

Figure 5:
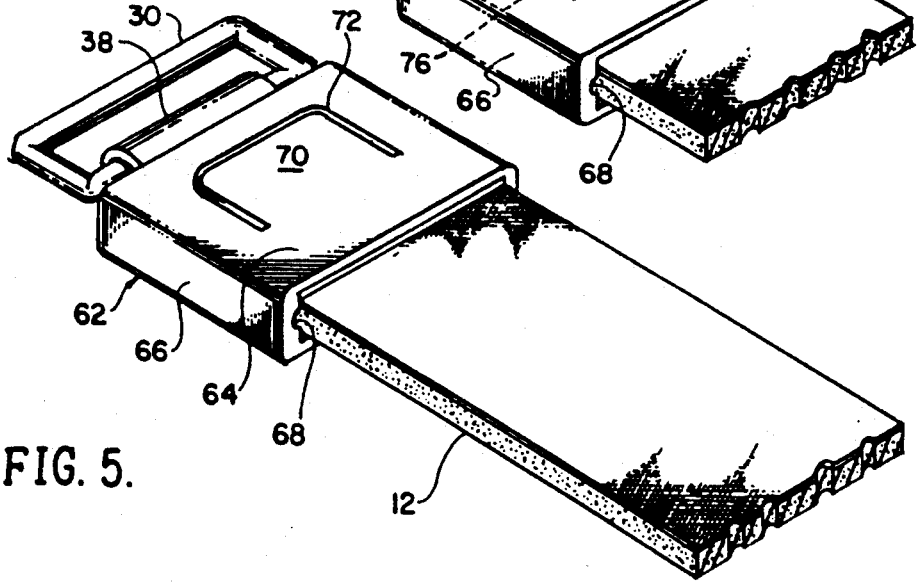
FIG. 5 is a perspective of a keeper surrounding the gripper shown in FIGS. 3 and 4, in assembled position, and showing the flat surfaces of the keeper lying in a closely spaced parallel plane to the surface of the neoprene strap.

The keeper or sleeve 62 must tightly embrace plates 34 and 36 to hold the plates in gripping engagement with the end of a strap. To do this, the tongues 70 of the keeper 62 are pried up to prevent the pins 74 and 76 under the tongue 70 from rubbing against the opposite surfaces of the strap 12. Then the keeper 62 is slid over the strap 12 until it passes over the plates 34 and 36. The keeper is sized so when this happens, the plates 34 and 36 squeezed together permitting the tool 35 shown in FIG. 4 to be withdrawn. To facilitate this movement, plate 34 is provided with a cam surface 78 which faces the oncoming keeper 62 and makes it possible for the keeper to be forced over the plates 34 and 36. When the keeper is positioned so pins 74 and 76 on the tongue 70 are aligned with the pin-receiving holes 42 and 48, the tongues are bent down until they are coextensive with the upper and lower walls 64 while the pins 74 and 76 penetrate the holes 42 and 48 in plates 34 and 36. This locks the keeper 62 to the gripper 32, and the gripper 32 is locked to the strap 12 by the pins 40 and 41 as shown in FIGS. 3 and 5.

Note that in assembled relationship, the flat surface 64 of the keeper 62 are generally parallel to the surface of the strap 12. With this arrangement, both the strap 12 and the keeper 62 can lie flat against the body of a person or animal using the strap as a harness. Consequently, forces from the weight of objects being carried are distributed along the harness causing the harness to be much more comfortable to the bearer when carrying loads over long distances.

Figure 6:
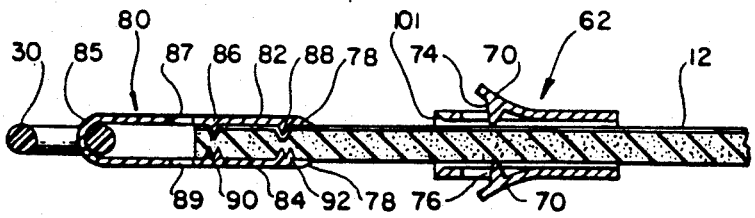
FIG. 6 is a side sectional view of a modified gripper disclosing strap engaging ridges formed on the inner top and bottom surfaces of the gripper in an intermediate stage of assembly.
Figure 7:
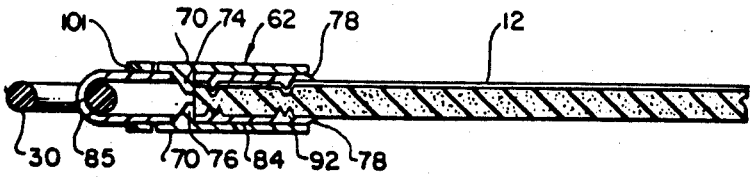
FIG. 7 is a side sectional view of the modified gripper shown in FIG. 6 surrounded by the keeper in assembled position.

A modified gripper 80 is shown in FIG. 6 and 7. In this embodiment, the gripper 80 is formed from plates 82 and 84 connected together by an arcuate channel-shaped portion 85 which is like the arcuate portion 38 shown in FIG. 4. Plate 82 is formed with a pair of inwardly projecting, pointed strap penetrating ridges 86 and 88 transverse to the plate and disposed in spaced, parallel relationship to each other along with pin-receiving holes 87. Plate 84 is formed with a pair double, inwardly projecting, pointed ridges 90 and 92 and with pin-receiving holes 89. When plates 82 and 84 are bent towards each other, the pointed ridges 86 and 88 and 90 and 92 facing each other, penetrate the opposed surfaces of strap 12. With the tongue 70 and the pins 74 and 76 in the position shown in FIGS. 4 and 6, the keeper 62 is slid over the strap 12 until the pins 74 and 76 are aligned with the pin-receiving holes 87 and 89. Next, the tongues 70 are bent down until the pins 74 and 76 penetrate the pin-receiving holes 87 and 89 to lock the keeper 62 to the gripper 80 and to lock the gripper 80 to the strap 12, see FIG. 7. As in the embodiment shown in FIG. 4, the opposed surfaces of the keeper 62 are flat and parallel with the surface of the strap 12 so they can lie flat against the body of the person using the strap 12, thereby preventing discomfort to the bearer carrying heavy loads.

Figure 8:
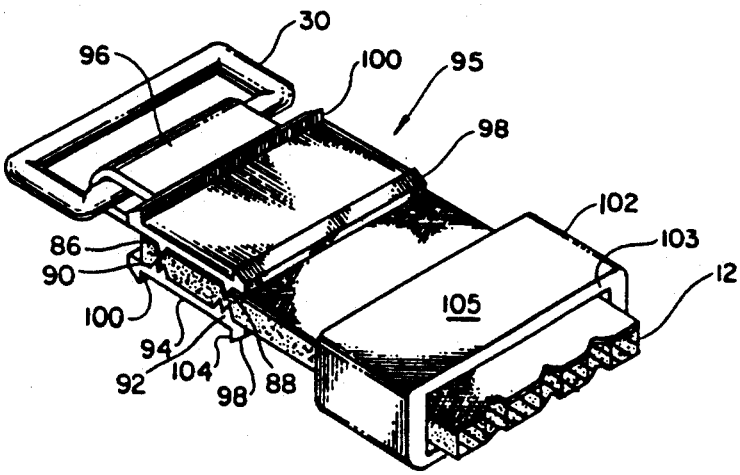
FIG. 8 is a perspective of still another modified gripper and a keeper which does not require a tongue and pins for penetrating holes in a gripper.

Another modified gripper 90 is shown in FIG. 8. This gripper is formed with plates 92 and 94 connected together by an arcuate channel-shaped portion 96 which is like the arcuate channel-shaped portion 38 shown in FIG. 4. Plates 92 and 94 are like plates 82 and 84 shown in FIG. 6 in that they are provided with inwardly facing ridges exactly like the ridges 86 and 88 and the ridges 90 and 92 shown in FIG. 6. But the opposite surfaces of plates 92 and 94 are provided with a cam surface 98 at the edge of the plates and a stop wall 100, see FIG. 8. The cam surface 98 extends at an inclined angle from the surface of the plates opposite the strap engaging surfaces.

Although the gripper 90 shown in FIG. 8 has pointed ridges 86 and 88 and 90 and 92 which serve as strap penetrating means, it is understood that strap penetrating pins 40, such as those shown in FIG. 3 could be substituted for these pointed ridges. In either event, the keeper 102 described below would function the same way.

Figure 9:
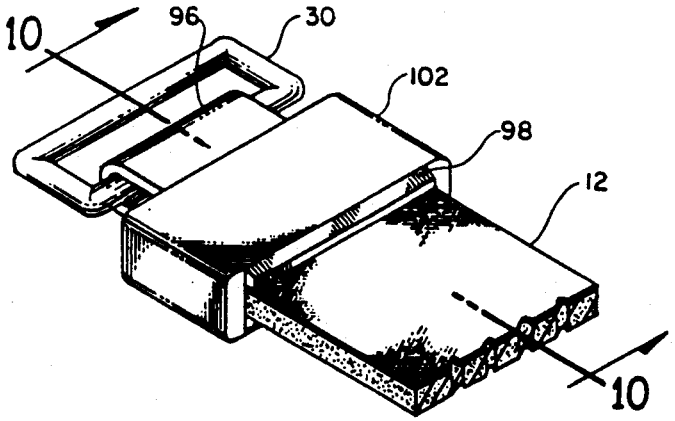
FIG. 9 is a perspective of the modified gripper and keeper shown in FIG. 8 in assembled position.
Figure 10:
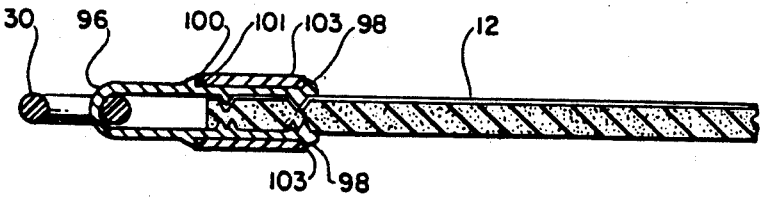
FIG. 10 is a view of the modified gripper and keeper taken on the line 10—10 of FIG. 9.

As will be described below, the keeper or sleeve 102 differs from the keeper 62 in that the tongue 70 and the downwardly extending projections 74 and 76 shown in FIGS. 4 and 6 are not required. In this embodiment, the end of strap 12 is inserted between the plates 92 and 94 and the plates are bent towards each other until the pointed ridges penetrate the opposite surfaces of the strap 12, see FIGS. 8 and 10. Then the keeper 102 is moved forward until the cam walls 101 on the edge of keeper 102 are forced over the cam surfaces 98 on plates 92 and 94. When this happens, the walls 105 of the keeper spread or diverge enough to permit the sleeve to be moved beyond the end of the cam surfaces 98. Then the walls 105 of the sleeve snap toward each other against the surface of the gripper, squeezing the plates 92 and 94 together while the sleeve is locked between the stop walls 100 and 104 with the edges 103 of the keeper abutting stop wall 104 and the edge 101 of the keeper abutting stop wall 100, see FIG. 10. The keeper 102 is dimensioned so when it is forced over the cam surface 98 into the region bounded by the stop walls 100 and 104, the pointed ridges on the opposed surfaces of the plates of the gripper are forced into the opposed surfaces of the strap far enough to tightly lock the gripper 90 to the end of the strap 12, see FIGS. 9 and 10.

Figure 11:
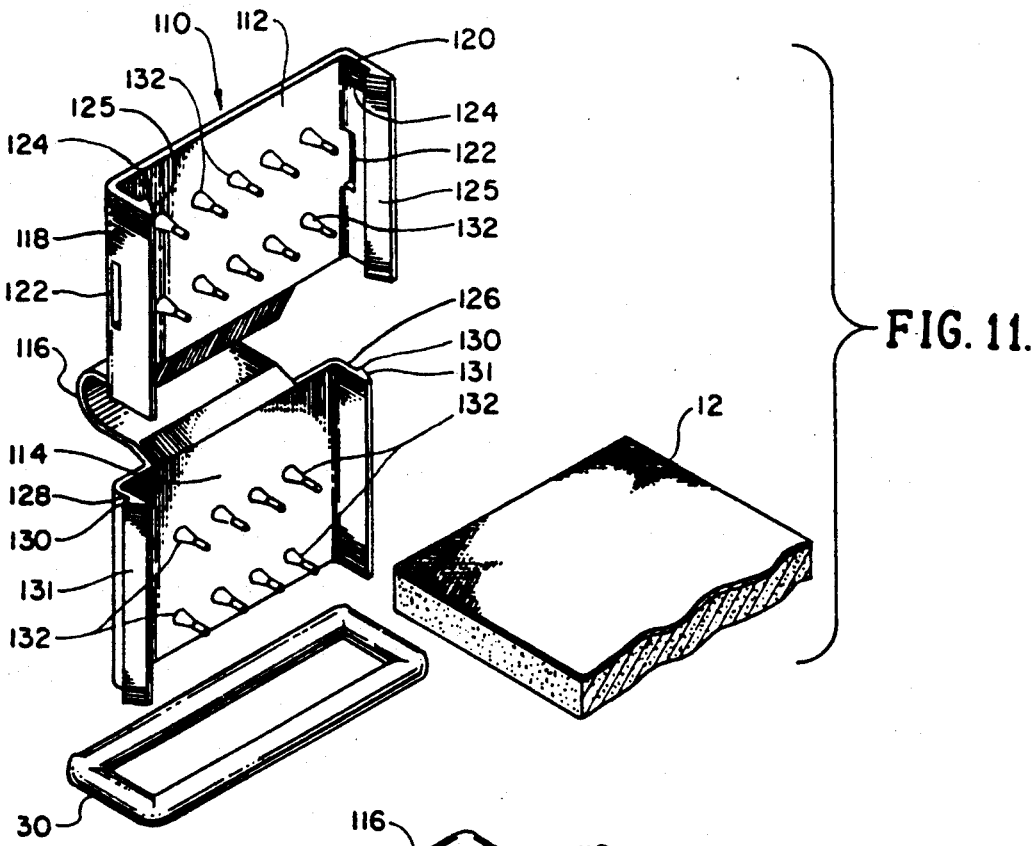
FIG. 11 is an exploded perspective of a modified gripper which can be used without a keeper.

Another modified connector is shown in FIG. 11. This connector performs the functions of a gripper and a keeper thereby eliminating the need for a separate keeper. In this embodiment, connector 110 which is formed from a resilient high-density polyethylene or delrin type material, is molded to form the plates 112 and 114 shown in FIG. 11. These plates are connected together by a generally arcuate or U-shaped flexing web 116. Plate 112 is provided with integrally attached side walls 118 and 120 extending generally transverse to plate 112. These walls are provided with an access opening 122 formed as shown. In addition, inwardly extending locking ledges 124 generally transverse to the walls 118 and 120 are formed near the distal edges of the walls 118 and 120. These ledges terminate in downwardly, outwardly inclined cam surfaces 125, see FIGS. 11 and 13.

Plate 114 is also provided with generally transverse side walls 126 and 128. These walls have outwardly extending locking ledges 130 generally transverse to the walls 126 and 128 and located near the distal edges of the side walls 126 and 128. These ledges terminate in upwardly, inwardly inclined cam surfaces 131, see FIGS. 11 and 13.

Plates 112 and 114 are also formed with inwardly extending pointed strap penetrating pins 123 extending transverse to the facing surfaces of plates 112 and 114. These pins are offset enough so when the plates 112 and 114 are bent towards each other, the pins on plate 112 do not engage the pins on plate 114.

Figure 12:
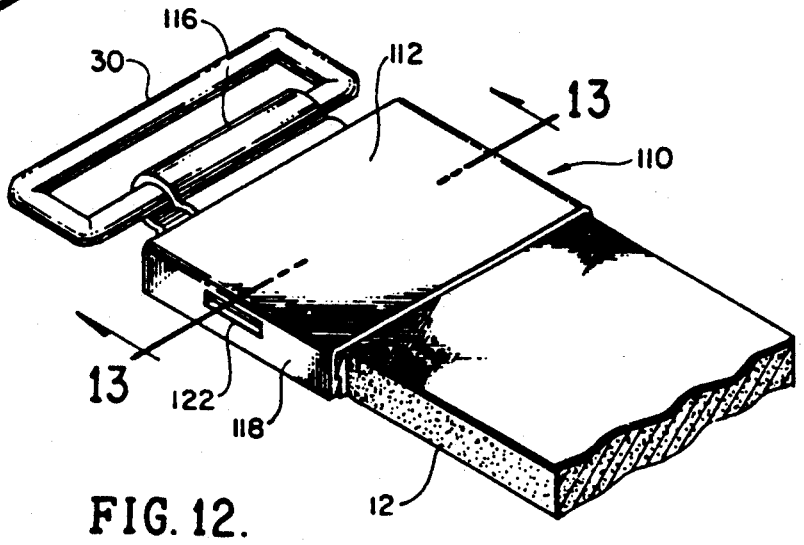
FIG. 12 is a perspective of the keeper shown in FIG. 11 in assembled position on a strap.
Figure 13:
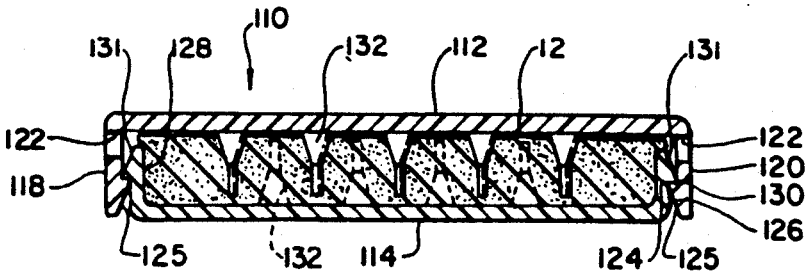
FIG. 13 is an enlarged cross sectional view of the modified gripper taken on the line 13—13 of FIG. 12.

To lock the connector 110 to the end of strap 12, plates 112 and 114 are bent toward each other with the end of strap 12 between them, until the pins 132 penetrate the opposed surfaces of the strap 12. As this is happening, the cam surfaces 125 on walls 118 and 120 engage and move down the diverging cam surfaces 131 on walls 128 and 130. This forces the resilient walls 118 and 120 apart until the locking ledges 124 at the end of cam surfaces 125 move beyond the end of cam surfaces 131. When this happens, the walls 118 and 120 snap inwardly in locking engagement with the walls 126 and 128 and with the locking ledges 124 and 130 bearing against each other as shown in FIGS. 12 and 13. The plates 112 and 114 along with their attached side walls are dimensioned so this happens when the pins or projections 132 have penetrated far enough into the opposed surfaces of the strap 12 to tightly lock the connector 110 to the end of strap 12 and with the loop 30 connected to the arcuate portion 116.

To open the connector, a screw driver or similar implement may be inserted through the access opening 122 and fored against the walls 126 or 128 to push the walls 126 and 128 inwardly far enough so the cam surface 125 on plate 112 can ride upward on the cam surface 131 of walls 126 and 128, permitting the plates 112 and 114 to be pulled apart.

As stated above, it would be desirable to replace the uncomfortable, irregularly shaped metal spring connectors commonly used in harnesses, with an attaching device which has a flat body engaging surface, thus preventing discomfort to an animal or person carrying heavy loads over rough terrain for long periods of time.

Figure 14:
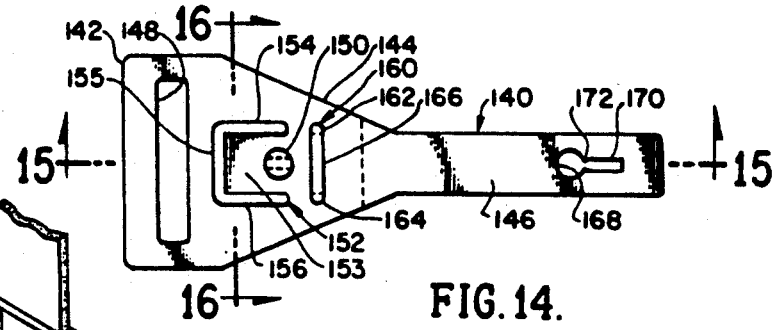
FIG. 14 is a plan view of a combined attaching loop and releaseable strap-like connector in an unfolded position.
Figure 15:
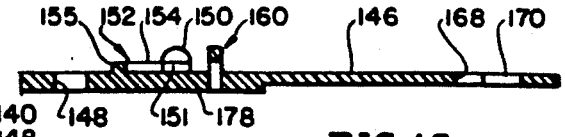
FIG. 15 is a side-sectional view taken on the line 15—15 of FIG. 14.

A combined loop and releasable connector or strap 140 is molded or formed from a material such as a flexible linear low-density polyethylene or similar material. This connector has a rectangular portion 142, an attached truncated triangular portion 144, and an elongated rectangular strap portion 146 extending generally transverse to the rectangular portion 142, see FIG. 14. It is understood however, that other configurations are contemplated as required. The strap portion 146 is thinner than portions 142 and 144 so it can be folded over itself, as shown in FIGS. 15, 17 and 18. The combined loop and connector 140 is molded so portion 142 is provided with a generally rectangular strap receiving slot 148.

An upwardly extending nipple 150 with a rounded dome and a narrow stem 151, is formed on the truncated triangular portion 144. The narrow stem is sized to slide snugly in the rectangular slot 170 formed in the strap portion, see FIGS. 14 and 17. The nipple is positioned at the entrance to a strap-receiving channel-shaped portion 152. This strap receiving portion is formed from parallel walls 154 and 156 which are connected together by a transverse stop wall 155 defining a rectangular strap receiving channel. These walls extend upward beyond the surface 153 of the combined loop and connector, a distance equal to the thickness of the strap portion 146. For reasons to become apparent below, the separation between the facing surfaces of the walls 154 and 156 is generally equal to the width of the strap portion 146, see FIGS. 17 and 18.

Figure 16:
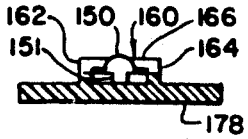
FIG. 16 is a sectional view taken on the line 16—16 of FIG. 14.

Portion 144 of the combined loop and connector is also formed with an upwardly extending loop 160 formed from spaced vertical walls 162 and 164 and a bridging wall 166 on the other side of the nipple, see FIG. 16. The separation between the facing surfaces of walls 162 and 164 in equal to the width of the strap portion 146 and the height of the facing surface of the bridging wall 166 is generally equal to the thickness of the strap portion, see FIG. 16. The strap portion 146 is also formed with a nipple-receiving hole 168 located adjacent its end, which is slightly smaller than the diameter of the dome or head of the nipple 150, permitting the head of the nipple to be forced into the nipple receiving hole 168. The nipple receiving hole communicates with the generally rectangular slot 170 which as stated above, is sized to snuggly receive the stem 151 of the nipple. A constriction 172 is formed at the entrance to the rectangular slot 170 and the nipple receiving hole 168 to prevent the stem 151 of the nipple from moving freely from the rectangular hole 170 to the nipple receiving hole 168, see FIG. 14 when the strap portion is folded or looped as shown in FIG. 17.

In use, as shown in FIGS. 17 and 18, the strap 146 is looped through a connecting ring 174 and the distal end of the strap portion 146 is forced under the loop or bridge 160. Next, the head of the nipple 150 is forced through the nipple receiving opening 168 and the strap portion is then forced in a direction which causes the stem 151 of the nipple to move through the constriction 172 and into the rectangular slot 170. When this happens, the distal end of the strap enters the channel-shaped portion and abuts against the facing surfaces of stop wall 155 and the facing surfaces of walls 154 and 156 thereby preventing any pivoting movement of the distal end of the strap on the nipple 150. This structure, in combination with the bridging wall 160 which holds the strap portion coextensive with the surface 153, and the constriction 172 between the nipple receiving opening 168 and the rectangular slot 170, functions as a safety mechanism and prevents the nipple from disengaging from the nipple receiving opening. Consequently, forces exerted on the harness can never force the nipple 150 to move out of the nipple receiving opening 168 thereby releasing the load from the harness. The combined loop and connector 140 has a flat body contacting surface 178 which does not inflict discomfort to the person or animal using it on a harness, see FIGS. 15, 18 and 19.

As shown in FIG. 18, an adjustable strap 180 may be formed from a fabric webbing. One end of the fabric webbing may be looped through the strap receiving slot 148 in the combined loop and connector while the other end of the fabric webbing may be looped through the connector ring 30 by any suitable means.

Under some circumstances, the adjustable strap 180 shown in FIG. 18 is not required. In that event, the connector 140 shown in FIG. 14 can be modified as shown in FIG. 22. The double connector strap 182 is similar to the connector 140 shown in FIG. 14 except that the slot 148 has been omitted and in its place a duplicate truncated triangular portion 144 and a duplicate elongated rectangular strap 146 extend from each end of the connector 182. The nipple 150 and the nipple receiving opening 168 and 170 along with the strap receiving portion 152 and the bridge 160 shown in FIG. 14, are formed the same way, at the opposite ends of the double connector, see FIG. 22. With this arrangement, the opposite ends of the double connector 182 shown in FIG. 22 can be quickly attached to devices such as binoculars as shown in FIG. 23 without the need for any auxiliary straps such as the fabric webbing 180 as shown in FIG. 18.

Having described the invention, what I claim as new is:

1. A carrying device comprising a first strap formed from a soft, resilient, flexible, foam-like material and a second strap formed from a stronger elastic material, said first and second straps overlying each other and extending in the same direction, said second strap fixedly attached to said first strap at uniformly spaced intervals and in such a way that the second strap forms a plurality of loops between its points of attachment to said first strap, the length of said second strap between the extreme points of attachment being greater than the length of said first strap between said extreme points when said straps are in a relaxed state, said loops sized so that when the first strap is stretched, beyond a certain point, the loops in the second strap become taut limiting further stretching of the first strap before the first strap can stretch enough to tear.

2. A carrying device comprising a comparatively wide first strap formed from a soft, resilient and flexible material and a second strap formed from a stronger fabric, said first and second straps overlying each other so they extend in the same direction, said second strap narrower than the first strap and fixedly attached to said first strap at uniformly spaced intervals and in such a way that the second strap forms a plurality of loops between its points of attachment to said first strap, the length of said second strap between the extreme points of attachment being greater than the length of said first strap between said extreme points when said straps are in a relaxed state, said loops sized so that when the first strap stretches beyond a certain amount, the loops in the second strap becomes taut limiting further stretching of the first strap before the first strap can stretch enough to tear, whereby the first strap functions as a first shock absorber until said loops become taut and the coaction between the second strap and the first strap functions as a second shock absorber after the loops become taut.

3. The carrying device described in claim 2 including an adjustable strap attached at one end to an extreme end of the first strap and the second strap, the opposite end of the adjustable strap having releaseable attaching means for attachment to an object being carried.

* * * * *